United States Patent [19]

Parviainen

[11] Patent Number: 4,538,805

[45] Date of Patent: Sep. 3, 1985

[54] COUNTER-ACTION DEVICE FOR EXERCISE DEVICE

[76] Inventor: Arno Parviainen, P.O. Box 1, SF-00601 Helsinki 60, Finland

[21] Appl. No.: 546,169

[22] Filed: Oct. 27, 1983

[30] Foreign Application Priority Data

Jul. 27, 1982 [FI] Finland ..... 822620

[51] Int. Cl.[3] ..... A63B 21/06

[52] U.S. Cl. ..... 272/118; 272/93; 272/117

[58] Field of Search ..... 272/118, 117, 134, 123, 272/143, 93; D21/196

[56] References Cited

U.S. PATENT DOCUMENTS

| | | | |
|---|---|---|---|
| D. 261,021 | 9/1981 | Lambert, Sr. | D21/196 |
| 4,349,192 | 9/1982 | Lambert, Jr. et al. | 272/118 |
| 4,358,107 | 11/1982 | Nissen | 272/118 |

*Primary Examiner*—Richard J. Apley
*Assistant Examiner*—Robert W. Bahr
*Attorney, Agent, or Firm*—Andrus, Sceales, Starke & Sawall

[57] ABSTRACT

A counter-action device for an exercise device comprising a stack of weight slabs preferably of equal weight and size, a desired part of the stack of weight slabs being adapted to serve as counter-weight for a physical exercise. On either side of the stack of weight slabs are supplementary weights which can be removably attached to the counter-action device by a locking mechanism.

6 Claims, 4 Drawing Figures

COUNTER-ACTION DEVICE FOR EXERCISE DEVICE

The present invention relates to a counter-action device for an exercise device.

BACKGROUND OF THE INVENTION

Exercise devices are used to exercise certain muscle groups or muscles and joints, whereby a muscle and joint are subjected to stress. For exercising different muscles and joints, the manufacturers design various pieces of equipment whose common feature is that the movement and strength of muscles and joints are transmitted by means of transmission mechanisms to a counter-action device, which counteracts this force. Hence, ready adjustment of the load of a counter-action device is essential, since the load determines the strength of this resistance force and the load must be readjusted quite often because of a variety of persons to practice and purposes of exercise.

In the present exercise devices, the most commonly used counter-action device comprises a stack of weight slabs. A stack of weight slabs generally includes approximately 10 to 30 weight slabs of equal size and weight. A desired number of weight slabs are mounted e.g. by means of a cotter on a transmission mechanism, whereby the load can be varied according to the number of weight slabs. Furthermore, a stack of weight slabs is generally guided by guiding rods or the like. This type of counter-action devices are safe, noiseless and their load adjustment can be readily and quickly effected.

A problem usually encountered in the use of a stack of weight slabs is the inadequate number of weights when using the same device for both normal keep fit programs and heavy exercise action. Thus, the weights are not always sufficient for even an amateur, let alone a strong athlete. In order to increase the load, it is necessary to suspend from a stack more weights, e.g. weight lifting discs, which is dangerous and inconvenient. If there is a sufficient number of weight slabs, the stack will be so high that, together with the displacement range required by said stack, the device will become too high, circa 2 to 3 meters, whereby working of a large number of slabs for a stack increases costs even further. If heavier, in other words longer and wider slabs are made, a stack of slabs won't grow unduly high. However, the increase or gap between weights will then be too much. When working on rather small practice weights, an increase of 10 to 15 kg at a time may be far too much. In addition, the options of choosing the total load will be too few. Another possibility is to adjust the gear ratio of transmission in a manner that even a small weight feels sufficiently heavy, thus eliminating the need for a large and high stack. In this case, however, a heavy gear ratio requires a long path of travel for the load and, secondly, the increase will be too much as a minor increase of weight means in fact a major increase because of the gear ratio. At the present time, when using a so-called normal stack of weights, it is necessary to compromise either with total load, proper increases or number of options unless the result is to be an exercise device 2 to 3 meters high, with over a meter high pile of costly manufactured weight slabs stacked therein.

SUMMARY OF THE INVENTION

An object of the present invention is to overcome the above drawbacks. A particular object of the invention is to provide a counter-action device, having both a sufficient loading capacity and plenty of options as well as sufficiently small increases at all loads. A further object is to provide a safe, easy to use and readily adjustable counter-action device. Still a further object of the invention is to provide a counter-action device that is simple, inexpensive to manufacture and adaptable to serve as counter-action equipment for low exercise devices.

According to the invention, there are supplementary weights mounted on either side of a stack of weight slabs. They can be removably affixed to a transmission mechanism. With the supplementary weights mounted on, the exercise device is equally safe, quick and light to use as a device provided with a normal stack of weight slabs, but the drawbacks of the latter are eliminated. If the entire stack of weight slabs is already piled on and the intention is to step up to an increased load, the supplementary weights on either side of said stack are coupled on and the degree of loading is adjusted by means of the basic stack.

According to the invention, the total weight of supplementary weights is preferably equal to the weight of a stack of weight slabs. Thus, by employing said supplementary weights, it is possible to choose from the basic stack a load exceeding the supplementary weights exactly with the same accuracy as in the minor load category. Thus, the degree of loading the device can be chosen sufficiently high, simultaneously maintaining proper increases and adding to the number of options. If compared to the prior art equipment, this serves to achieve a double loading capacity and double number of options in the device, while at the same time maintaining sufficiently small increases at all loads. In addition, the equipment is not any higher than the presently used equipment. The equipment is also safe since there is no need to use separate slabs or the like as supplementary weights.

According to the invention, the supplementary weights are preferably of equal weight and size. Thus, the equal supplementary weights counterbalance each other's action and facilitate their handling. Furthermore, by virtue of their conformity, the supplementary weights can be readily manufactured e.g. by using some heavy material, such as lead, as a weight. The housing of such a supplementary weight can be made e.g. of steel and its core of lead, resulting in lower manufacturing costs than those of equally heavy weight slabs.

According to the invention, the locking mechanism of said supplementary weights preferably comprises a knob, a lock pin and guides. The knob is fixed to said lock pin and readily maneuvreable manually for moving the lock pin on said guides. Still according to the invention, the topmost weight slab of a stack of weight slabs is machined to form a notch for the lock pin of a locking mechanism. By maneuvering the knob said lock pin is caused to move into the notch in said weight slab and can be locked therein and, thus, the supplementary weights are moved together with the top weight slab.

DESCRIPTION OF THE DRAWINGS

The invention will now be explained with reference made to the accompanying drawings, in which.

DESCRIPTION OF THE ILLUSTRATED EMBODIMENT

Figure 1:
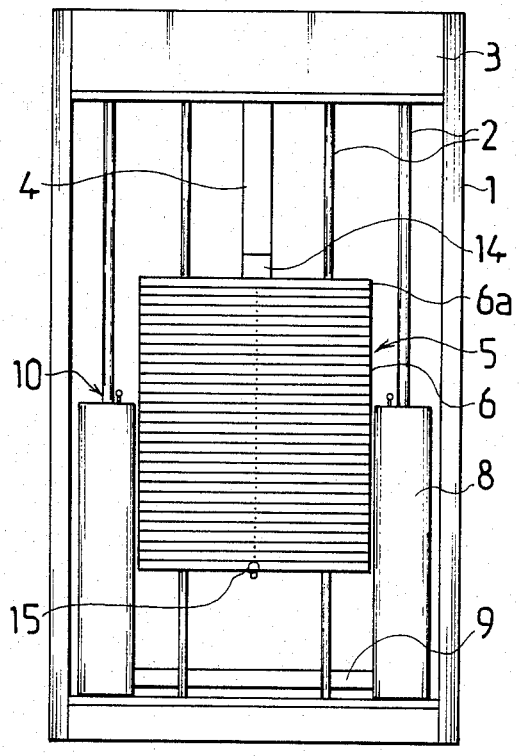
FIG. 1 is a back view of one embodiment of a device of the invention with a stack of weight slabs secured to a transmission mechanism and uplifted.
Figure 2:
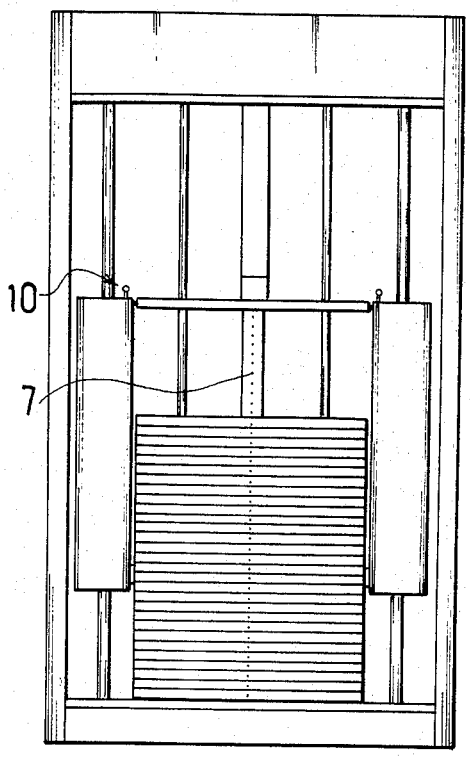
FIG. 2 is a back view of the device shown in FIG. 1 with supplementary weights mounted on the top weight slab and uplifted.

The device shown in FIGS. 1 and 2 comprises a frame 1, guide rods 2, a power transmission mechanism 3 and a counter-action device 5. Guide rods are secured at their ends to the device frame. The counter-action device comprises a stack of weight slabs consisting of weight slabs 6 of equal weight and size. Said weight slabs can be removably secured to a rope-like element 4 which through transmission mechanism 3 communicates with equipment (not shown in the figures) used for physical exercises. Thus, the counter-action device resists the exercise action and exerts load on the muscles and joints to be exercised. Permanently fixed to the end 14 of said rope element is the top weight slab 6*a*. Also secured to the end is a rod 7 acting as a locking element for weight slabs. The weight slabs can be secured to rod 7 by means of a cotter pin 15. Thus, the weight slabs are so prepared that holes are provided therein for guide rods, a central hole for the locking rod and a side hole for the eotter pin. The cotter pin can be used to mount a desired number of weight slabs on rod 7, said weight slabs moving upwards along the guide rods as element 4 is lifted up. The movement of a stack of weight slabs or part of such stack depends on the exercise movement and the transmission gear ratio.

Mounted on either side of a stack of weight slabs are supplementary weights 8. The supplementary weights are mutually of equal weight and supported to each other by means of a support rod 9, whereby they counterbalance and support each other when lifted up. Each supplementary weight is made integral which means low manufacturing costs. Such a weight comprises a shell or housing 16 that contains some heavy material, preferably lead. The combined weight of supplementary weights is equal to that of a stack of weight slabs. Hence, the application of supplementary weights doubles the load and options of a device while maintaining a small increase gap.

Figure 3:
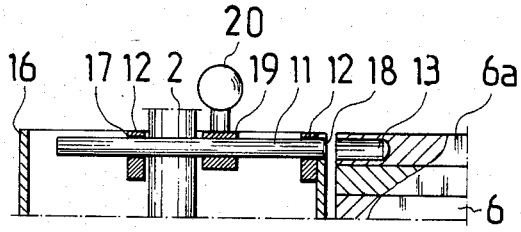
FIG. 3 shows in partial cross-section and in side view a locking mechanism for the supplementary weights of a device of the invention.
Figure 4:
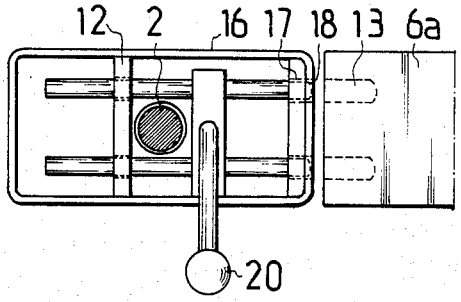
FIG. 4 is a plan view of the device shown in FIG. 3 with the cover removed.

As shown in FIGS. 3 and 4, the supplementary weights can be locked to the top weight slab if desired. A locking mechanism (10) comprises a knob 20, lock pins 11 as well as guides 12. Guides 12 are mounted on housing 16 of the supplementary weights and provided with holes 17 for lock pins 11 moving therethrough. Said housing of the supplementary weights is provided with an aligned hole 18 through which the lock pins can be moved. Knob 20 is connected to the lock pins by means of an advancer 19. Thus, maneuvering of the knob also moves the lock pins in the desired direction. The top weight slab 6*a* of a stack of weight slabs has been machined to form a notch 13. When the stack of weight slabs and the supplementary weights are in their rest position, said knob 20 is pushed towards the weight slabs, whereby lock pins 11 move into notches 13 and engage the supplementary weights securely to weight slab 6*a*. The cotter pin can then be used to select a desired number of weight slabs from the basic stack for a given physical exercise. As such exercise is being performed, the supplementary weights rise along with the top weight slab and are steered by said guide rods.

The invention has been described above with reference made to one embodiment thereof, but the invention is by no means to be limited to such embodiment as it covers all alternatives within the scope of the inventive idea set forth in the claims.

I claim:

1. An exercise device, comprising a frame, guide means mounted on the frame, a transmission mechanism including connecting means, a stack of weight slabs mounted for movement relative to said frame on said guide means, the uppermost slab of said stack being attached to said connecting means and the remaining slabs in said stack being selectively removably connected to said connecting means, a supplemental weight disposed on each side of said stack of weight slabs and mounted for movement relative to said frame on said guide means, and locking means for selectively locking each of the supplemental weights to said uppermost slab, a selected number of said slabs being adapted to serve as counterweight for physical exercise and said supplemental weights being selectively connectable to said uppermost slab to increase the magnitude of said counterweight.

2. The device of claim 1, wherein the combined weight of said supplemental weights is equal to that of said stack.

3. The device of claim 1, wherein said supplemental weights are of equal weight and uniform size.

4. The device of claim 1, wherein said locking means comprises a first locking element mounted on the upper portion of each supplemental weight and a second locking element engageable with the first locking element and carried by said uppermost slab.

5. The device of claim 4, wherein said first locking element comprises a pin mounted for horizontal sliding movement on said supplemental weight and said second locking element comprises a notch in said uppermost slab.

6. The device of claim 1, and including a connecting member connecting the supplemental weights together.

* * * * *